US007533534B2

(12) United States Patent
Alkabie

(10) Patent No.: US 7,533,534 B2
(45) Date of Patent: May 19, 2009

(54) HPT AERODYNAMIC TRIP TO IMPROVE ACOUSTIC TRANSMISSION LOSS AND REDUCE NOISE LEVEL FOR AUXILIARY POWER UNIT

(75) Inventor: Hisham Alkabie, Oakville (CA)

(73) Assignee: Pratt & Whitney Canada Corp., Longueuil (CA)

( * ) Notice: Subject to any disclaimer, the term of this patent is extended or adjusted under 35 U.S.C. 154(b) by 55 days.

(21) Appl. No.: 11/797,416

(22) Filed: May 3, 2007

(65) Prior Publication Data

US 2007/0227119 A1 Oct. 4, 2007

Related U.S. Application Data

(62) Division of application No. 10/277,920, filed on Oct. 23, 2002, now Pat. No. 7,234,304.

(51) Int. Cl.
*F02C 7/18* (2006.01)

(52) U.S. Cl. ..... 60/772; 60/805; 60/806; 415/115

(58) Field of Classification Search ..... 60/772, 60/782, 805, 806, 725; 415/115
See application file for complete search history.

(56) References Cited

U.S. PATENT DOCUMENTS

| | | | | | |
|---|---|---|---|---|---|
| 2,489,683 | A | * | 11/1949 | Stalker | 60/726 |
| 3,135,496 | A | * | 6/1964 | Scheper, Jr. | 415/117 |
| 3,490,747 | A | * | 1/1970 | De Corso et al. | 60/805 |
| 3,608,310 | A | | 9/1971 | Vaught | |
| 3,710,889 | A | | 1/1973 | Lamy | |
| 3,776,363 | A | | 12/1973 | Kuethe | |
| 3,800,864 | A | * | 4/1974 | Hauser et al. | 415/115 |
| 4,199,936 | A | | 4/1980 | Cowan et al. | |
| 4,284,170 | A | | 8/1981 | Larson et al. | |
| 4,353,679 | A | * | 10/1982 | Hauser | 415/115 |
| 4,739,621 | A | | 4/1988 | Pettengill et al. | |
| 4,946,346 | A | * | 8/1990 | Ito | 415/115 |
| 5,140,819 | A | | 8/1992 | Napier et al. | |
| 5,197,852 | A | * | 3/1993 | Walker et al. | 415/115 |
| 5,592,813 | A | | 1/1997 | Webb | |
| 6,170,265 | B1 | | 1/2001 | Polifke et al. | |
| 7,004,720 | B2 | * | 2/2006 | Synnott et al. | 415/115 |
| 2002/0073690 | A1 | | 6/2002 | Tse | |

FOREIGN PATENT DOCUMENTS

| | | |
|---|---|---|
| GB | 1193587 | 6/1970 |
| GB | 2030653 | 4/1980 |
| JP | 6-173711 | 6/1994 |

* cited by examiner

*Primary Examiner*—Ted Kim
(74) *Attorney, Agent, or Firm*—Ogilvy Renault LLP

(57) ABSTRACT

A method and device for decoupling combustor attenuation and pressure fluctuation from turbine attenuation and pressure fluctuation in a gas turbine engine. The engine has: a compressor; a combustor; and a turbine, that generate a flow of hot gas from the combustor to the turbine. An aerodynamic trip is disposed in at least one of; a combustor wall; and an inner shroud of the nozzle guide vane ring, and is adapted to emit jets of compressed air from cross flow ports into the flow of hot gas from the combustor. The air jets from the cross flow ports increase turbulence and equalize temperature distribution in addition to decoupling the attenuation and pressure fluctuations between the combustor and the turbine.

3 Claims, 6 Drawing Sheets

HPT AERODYNAMIC TRIP TO IMPROVE ACOUSTIC TRANSMISSION LOSS AND REDUCE NOISE LEVEL FOR AUXILIARY POWER UNIT

REFERENCE TO RELATED APPLICATION

This application is a divisional application of U.S. patent application Ser. No. 10/277,920 filed Oct. 23, 2002, now U.S. Pat. No. 7,234,304.

TECHNICAL FIELD

The invention relates to a method and device for decoupling combustor attenuation and pressure fluctuation from turbine attenuation and pressure fluctuation in a gas turbine engine.

BACKGROUND OF THE ART

Gas turbine engines are required to perform at low emission levels and low noise levels during full power operation. Ideally any modifications made to a combustor to achieve lower emission levels or lower noise levels do not involve any compromise in durability or reliability.

At the compressor exit, testing indicates that pressure fluctuations include a mix of broadband low frequency signals and high frequency signals that are not solely attributable to acoustic causes. Attenuation of a broadband low and high frequency signals occurs in the combustion chamber and signals are dissipated in the turbine stage. At all engine speeds tone free low frequency signal are generated by the combustor. Pure acoustic propagation would show that combustor frequency ranges and far field would be related to the compressor pressure fluctuations by a simple time delay. This has not been found to be the case but rather the combustor itself is a source of far field low frequency noise.

It is an object of the present invention to provide a simple solution to enhance the acoustic transmission loss through the turbine stage and therefore to improve the overall engine noise level. Noise reduction techniques are of course well known however to date there appears to be no recognition that pressure fluctuations at the compressor exit are coupled with low frequency noise from the combustor.

For example, U.S. Patent Application Publication No. US2002/0073690 to Tse discloses an exhaust from a gas turbine engine with perforations to reduce noise level caused by exhaust mixing with bypass airflow from the turbine fan engine.

An object of the present invention however is to improve acoustic transmission loss through the turbine without compromising engine durability or reliability at minimum cost.

Further objects of the invention will be apparent from review of the disclosure, drawings and description of the invention below.

DISCLOSURE OF THE INVENTION

The invention provides a method and device for decoupling combustor attenuation and pressure fluctuation from turbine attenuation and pressure fluctuation in a gas turbine engine. The engine has: a compressor; a combustor; and a turbine, that generate a flow of hot gas from the combustor to the turbine. An aerodynamic trip is disposed in at least one of; a combustor wall; and an inner shroud of the nozzle guide vane ring, and is adapted to emit jets of compressed air from cross flow ports into the flow of hot gas from the combustor. The air jets from the cross flow ports increase turbulence and equalize temperature distribution in addition to decoupling the attenuation and pressure fluctuations between the combustor and the turbine.

The principle behind the invention is the decoupling of compressor pressure fluctuations and combustor low frequency noise signals by tripping the hot gas flow from the combustor by means of a relatively small volume of cross flow air. Incoming cross flow of air creates a step change in the direction of flow. As a consequence the promotion of regional turbulence by the cross flow of air enhances mixing thereby improving the overall temperature distribution at the turbine stage as well as decoupling between the attenuation and the pressure fluctuation within the compressor and the attenuation and pressure fluctuations in the combustor.

The invention is applicable to conventional annular and canular combustion systems. The acoustic and aerodynamic performance at the exit plane of the combustor to turbine section entry has a strong dependence on the geometry of the exit plane and on the amount of air added by the jets. The invention enables air injection into the exit plane and can be used to redefine the geometry.

DESCRIPTION OF THE DRAWINGS

In order that the invention may be readily understood, embodiments of the invention are illustrated by way of example in the accompanying drawings.

Further details of the invention and its advantages will be apparent from the detailed description included below.

DETAILED DESCRIPTION OF PREFERRED EMBODIMENTS

Figure 1:
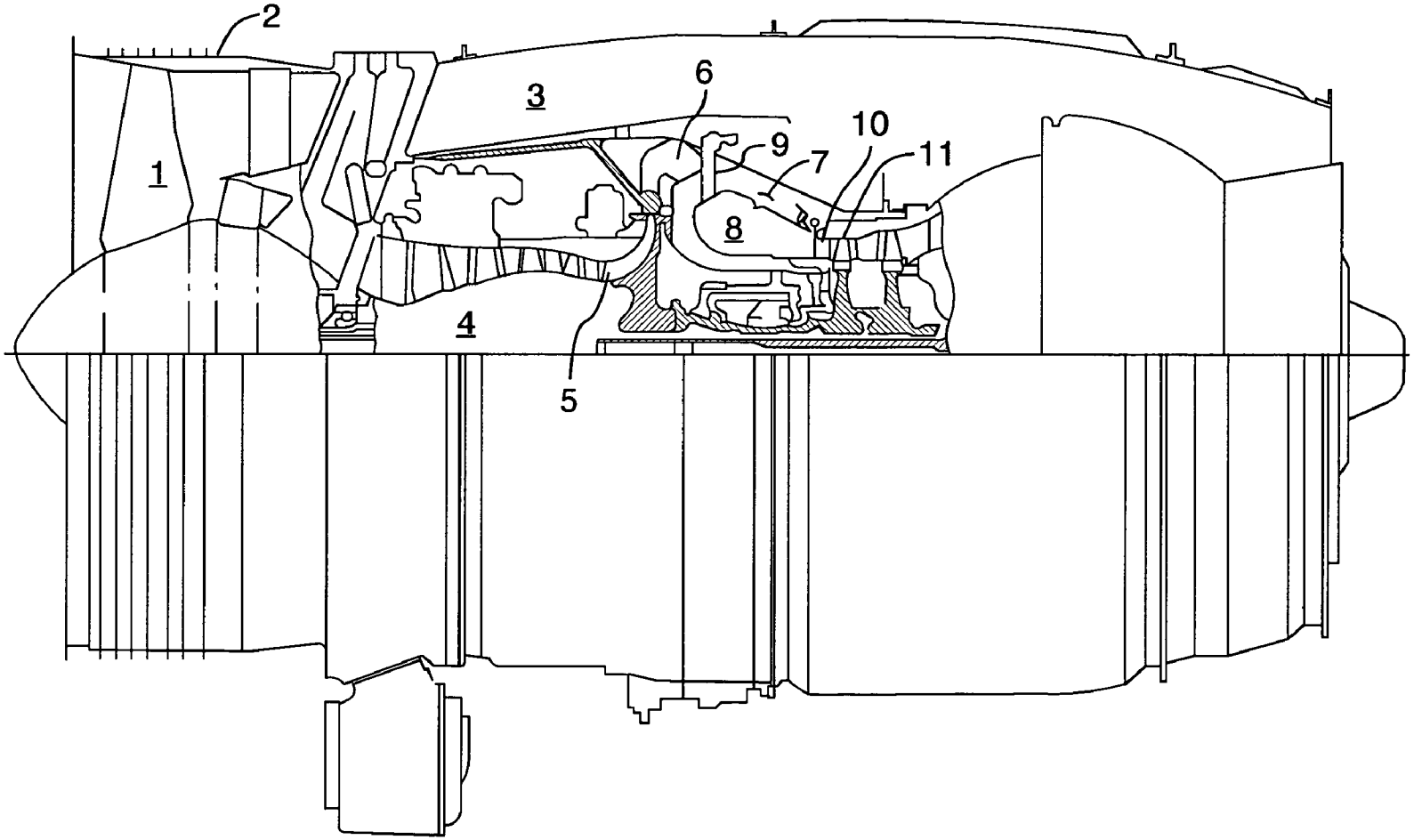
FIG. 1 is a partial axial cross-sectional view through a turbo fan gas turbine engine to illustrate the general layout of a typical engine to which the invention can be applied.

FIG. 1 shows an axial cross-section through a turbo fan gas turbine engine. It will be understood however that the invention is applicable to any type of engine with a combustor and turbine section such as for example turbo shaft, turbo prop, or auxiliary power units. Air intake into the engine passes over fan blades 1 surrounded by a fan case 2. The air is split into an outer annular flow which passes through the bypass duct 3 and an inner flow which passes through the low-pressure axial compressor 4 and high-pressure centrifugal compressor 5. Compressed air exits the compressor through diffuser 6 and is contained within a plenum 7 that surrounds the combustor 8. Fuel is supplied through the combustor 8 through fuel tubes 9 which is mixed with air from the plenum 7 as it sprays through nozzles into the combustor as a fuel air mixture that is ignited. At portion of the compressed air within the plenum 7 is admitted into the combustor 8 through orifices in the side walls to create a cooling air curtain along the combustor walls or is used for impingement cooling eventually mixing with the hot gases from the combustor 8 and passing over the nozzle guide vane 10 then past the turbines 11 before exiting the tail of the engine as exhaust.

The acoustic transmission loss through the turbine can be improved by decoupling pressure fluctuations at the compressor exit from those created within the turbine by tripping the combustor flow as it exits the combustor and passes the over the nozzle guide vane 10.

Figure 2:
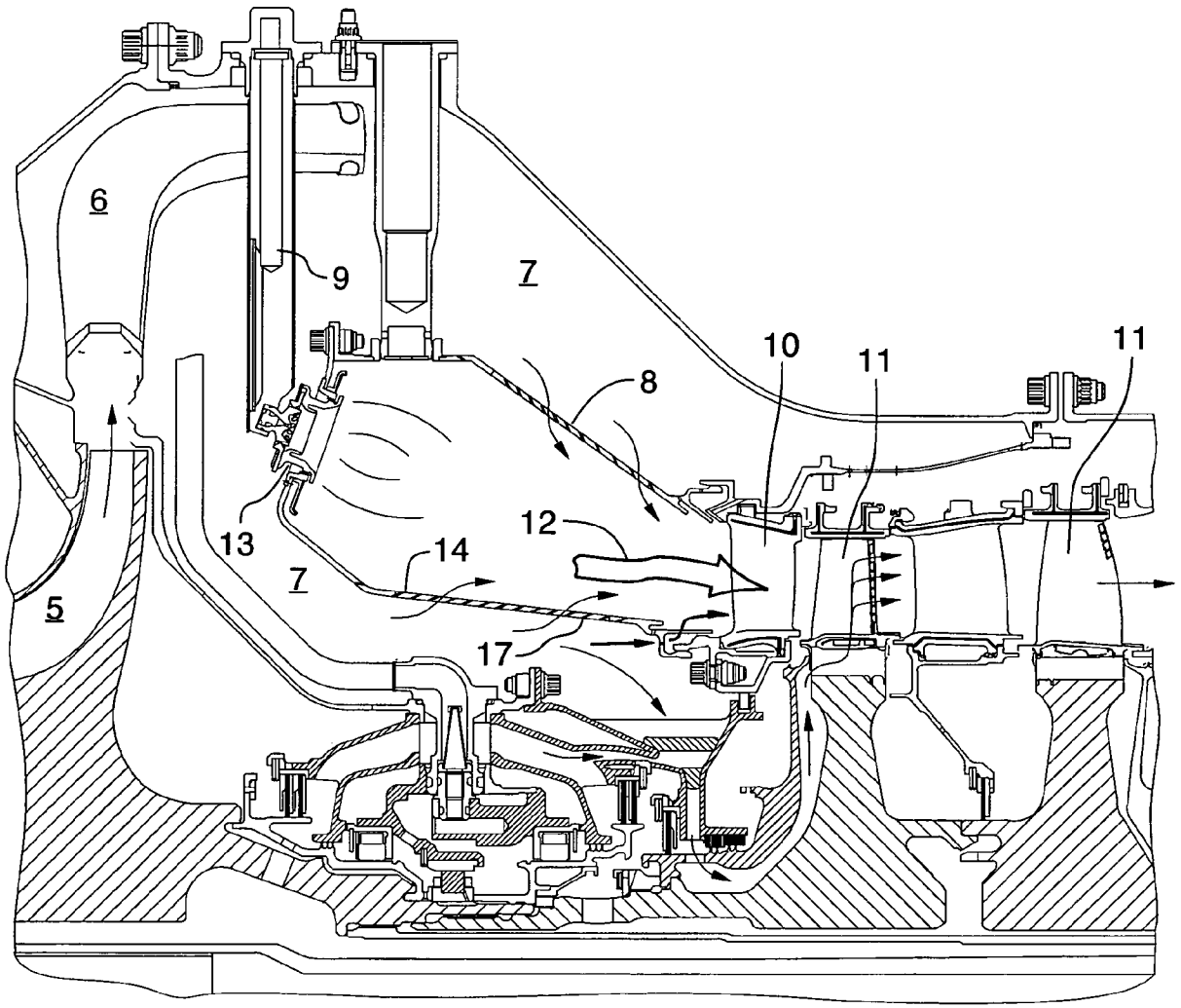
FIG. 2 is a detailed view axial cross-section through the compressor outlet axial flow annular combustor and adjacent turbine section indicating with arrows the flow of compressed air and hot gas.
Figure 3:
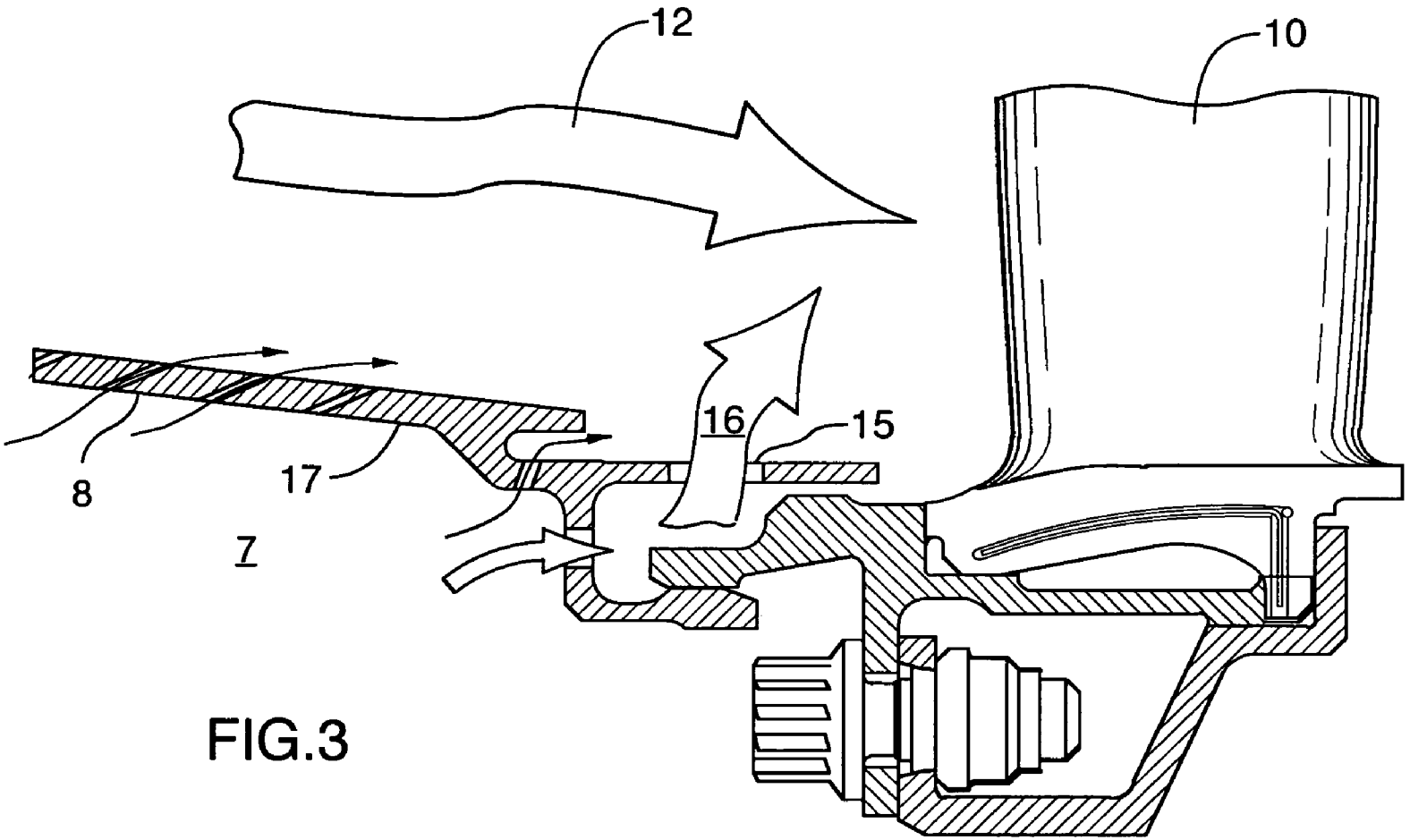
FIG. 3 is a detailed view of a combustor exit showing hot gas path flow that is subjected to cross flow of cooling air from a number of circular ports.

With reference to FIGS. 2 and 3, a first embodiment of the invention will be described. The compressor 4, 5 and the combustor 8 generate an annular flow of hot gas indicated by arrow 12 which exits from the combustor through the nozzle guide vane ring 10 to the turbines 11. The plenum 7 surrounds the combustor 8 and supplies compressed air through the fuel nozzle 13. The plenum 7 also supplies compressed air through a number of small orifices 14 in the combustor walls to create a cooling air film that mixes with the hot gas flow 12.

A portion of the compressed air from the plenum 7 is directed as shown in FIG. 3 through a number of cross flow ports 15. In the embodiment illustrated in FIGS. 2 and 3, the cross flow ports are shown as circular orifices however other configurations are within the scope of the invention. Each cross flow port 15 emits a radially outward directed jet 16 of compressed air into the annular flow of hot gas 12 from the combustor 8.

Figure 4:
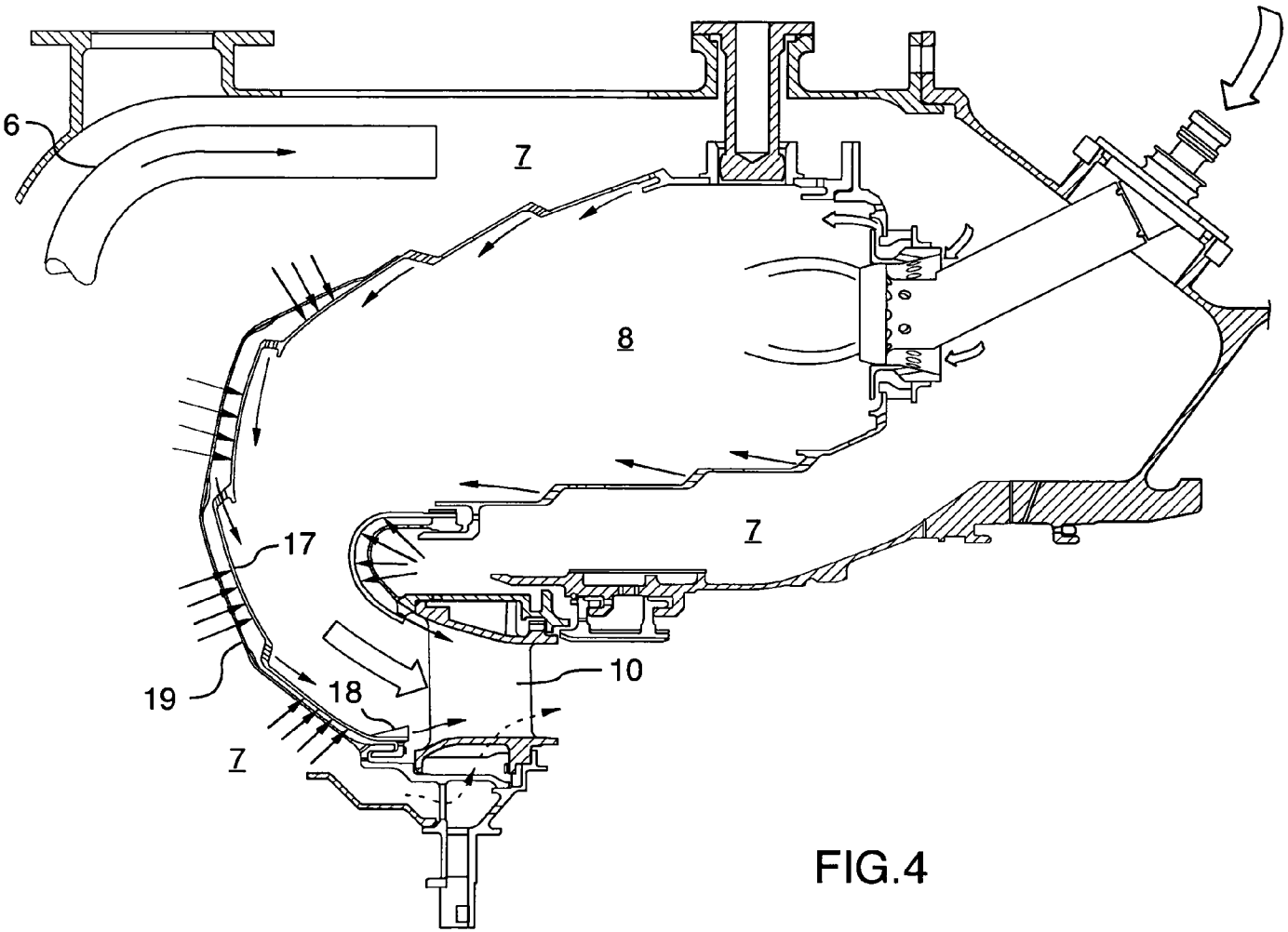
FIG. 4 is a detailed axial cross-section view of an alternative reverse flow combustor in axial cross-section.
Figure 5:
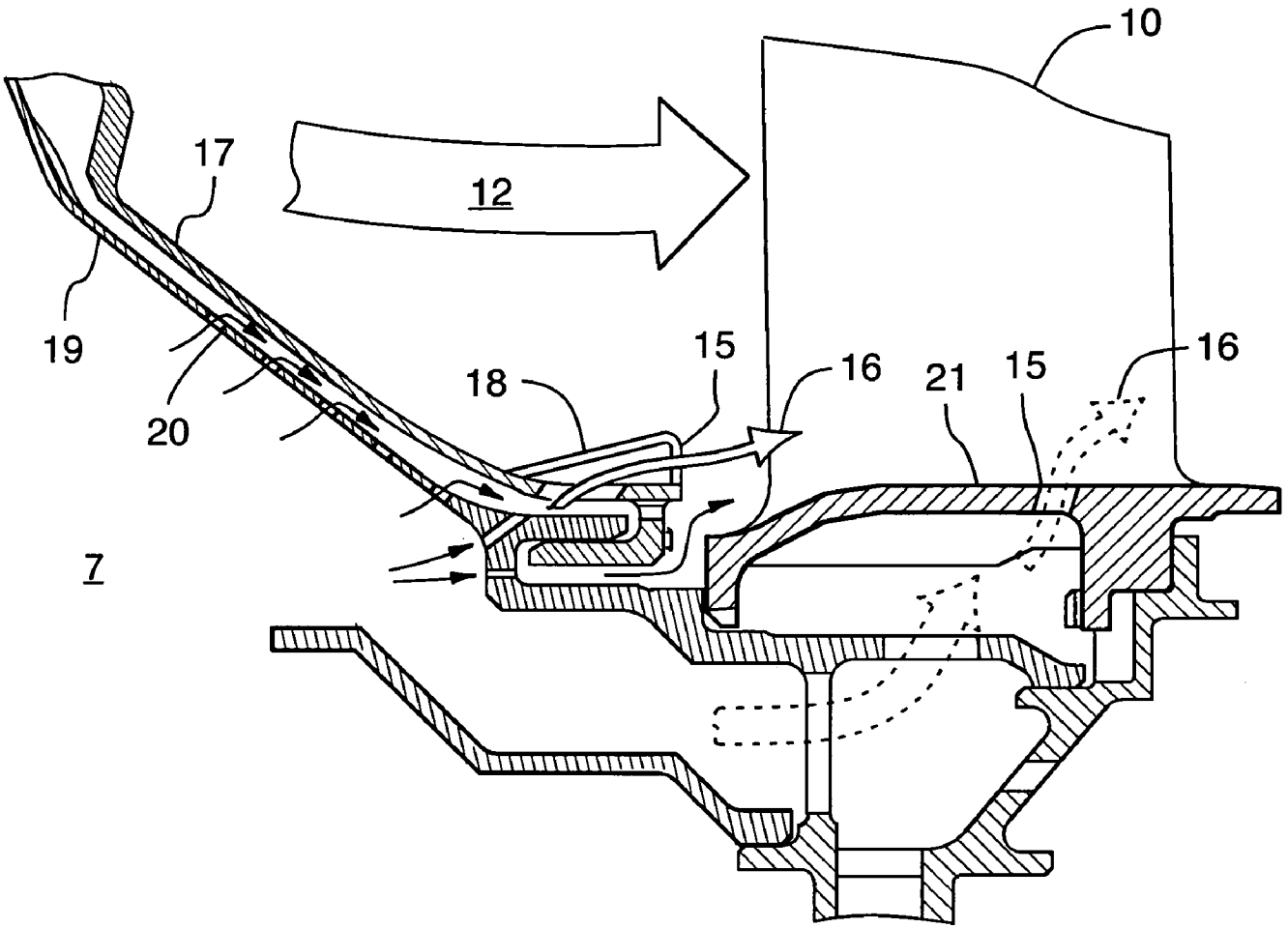
FIG. 5 is a detailed view of the reverse flow combustor exit showing hot gas from the combustor being subjected to a cross flow of air directed through a number of louvers in the combustor exit and alternative showing cross flow of air through orifices in the inner shroud of the vane ring.

In the embodiment shown in FIG. 3, the cross flow port 15 is disposed in an inner combustor wall 17. In the embodiment shown in FIGS. 4 and 5, the cross flow port comprises a louver 18 in the combustor wall 17. In this alternative arrangement, the combustor wall 17 includes an impingement plate 19 with a series of impingement orifices 20 for cooling of the combustor wall 17. Spent air from impingement cooling is directed to the louver 18 for creating of the cross flow jet 16. Alternatively, as shown in FIGS. 4 and 5 the cross flow ports 15 may be formed in the inner shroud 21 of the nozzle guide vane ring 10.

Figure 6:
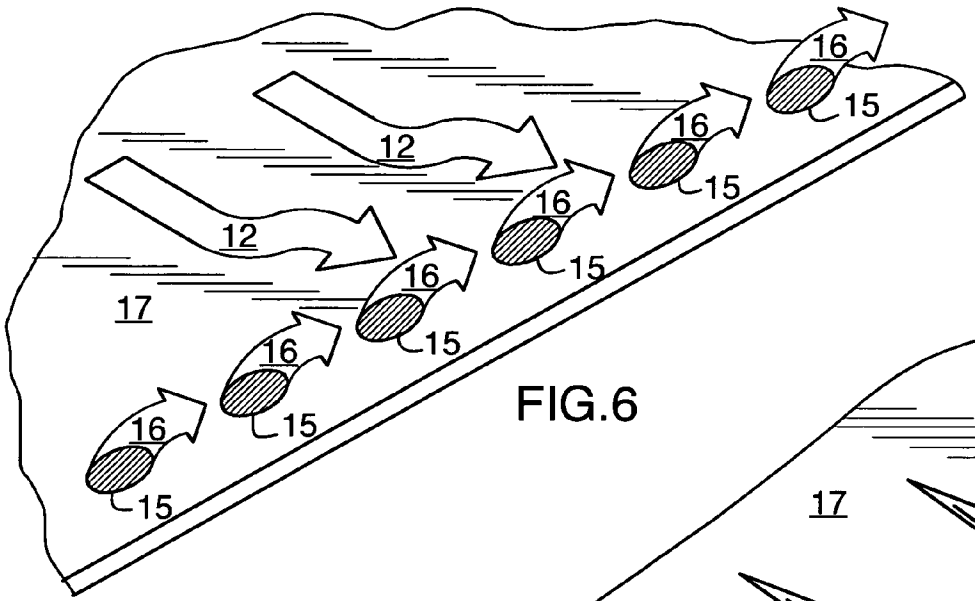
FIG. 6 shows a perspective view of the cross flow openings of FIGS. 2 and 3.
Figure 7:
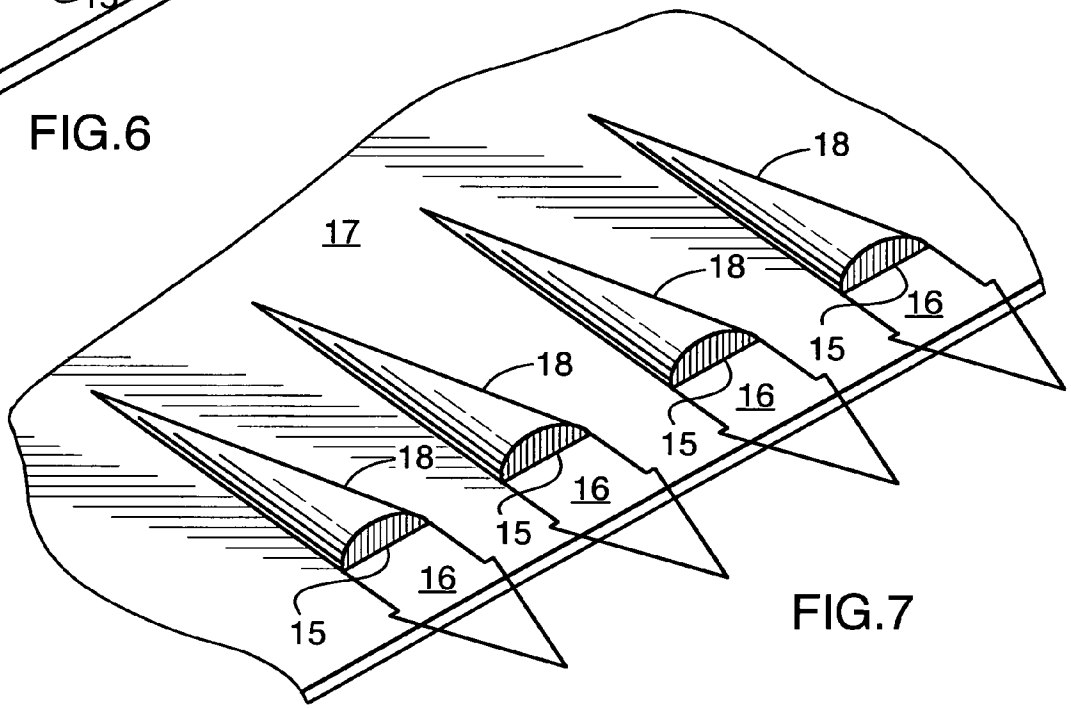
FIG. 7 shows a perspective view of the louvers of FIGS. 4 and 5.

As indicated in FIGS. 6 and 7, the cross flow ports 15 may be disposed within the combustor wall 17 or inner shroud 21 in a circumferential spaced apart vane array.

As a result, the invention provides decoupling of combustor attenuation and pressure fluctuation from turbine attenuation and pressure fluctuation within the gas turbine engine. The decoupling is achieved through generation of an aerodynamic trip comprising a plurality of radially outwardly directed jets 16 of compressed air into the annular flow of hot gas from the combustor 8. Cross flow ports 15 are provided with compressed air from the compressor 4, 5 through the plenum 7.

Noise reduction of the broadband noise across the entire spectrum from 0 Hz to 12,000 Hz or higher may be caused partly by choking and partly by air jet placement and quantity of air injected at the turbine entry plane. It is possible that the nozzle throat may not be fully choked acoustically although it may be choked aerodynamically. The present invention reduces the dependency on aerodynamic choking through the decoupling effect provided at the nozzle entry.

Although the above description relates to the specific preferred embodiments as presently contemplated by the inventor, it will be understood that the invention in its broad aspect includes mechanical and functional equivalents of the elements described herein.

I claim:

1. A method of reducing far field low frequency noise created by a combustor of a gas turbine engine, the engine having, a compressor, the combustor being an annular combustor having an inside wall and an outside wall, and a turbine, the engine having a centreline axis and defining an annular gas path adapted to guide an annular flow of hot gas from the annular combustor, through a nozzle guide vane ring to the turbine, the method comprising:

emitting a plurality of jets of compressed air from an inner shroud of the nozzle guide vane ring downstream of a combustor exit annular flow of hot gas upstream of the turbine in a direction substantially perpendicular to the flow of gas in the gas path and adjacent an exit of the annular combustor to introduce turbulence into the flow substantially downstream of the annular combustor and equalize a temperature distribution of the flow, the turbulence in the hot gas flow resulting in a decoupling between sound attenuation and pressure fluctuation within the turbine and sound attenuation and pressure fluctuations in the combustor.

2. A method according to claim 1 wherein the jets are emitted from a plurality of cross flow ports in communication with the compressor.

3. A method according to claim 1 wherein an outside wall of the nozzle guide vane ring opposing each port is free of cross-flow ports adapted to emit a jet of compressed air into the gas path in a direction substantially perpendicular to the flow of gas in the gas path.

* * * * *